US011236579B2

(12) United States Patent
Mitchell et al.

(10) Patent No.: US 11,236,579 B2
(45) Date of Patent: Feb. 1, 2022

(54) RETRIEVABLE ANTI-EXTRUSION FOLDBACK-RING BACKUP FOR SEALING ELEMENT

(71) Applicant: WEATHERFORD TECHNOLOGY HOLDINGS, LLC, Houston, TX (US)

(72) Inventors: Michael W. Mitchell, Houston, TX (US); Gary D. Ingram, Richmond, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 16/954,148

(22) PCT Filed: Feb. 4, 2020

(86) PCT No.: PCT/US2020/016543
§ 371 (c)(1),
(2) Date: Jun. 15, 2020

(87) PCT Pub. No.: WO2020/163301
PCT Pub. Date: Aug. 13, 2020

(65) Prior Publication Data

US 2021/0140265 A1 May 13, 2021

Related U.S. Application Data

(60) Provisional application No. 62/801,496, filed on Feb. 5, 2019.

(51) Int. Cl.
*E21B 33/12* (2006.01)
*E21B 23/06* (2006.01)
*E21B 33/128* (2006.01)

(52) U.S. Cl.
CPC ..... *E21B 33/1216* (2013.01); *E21B 23/06* (2013.01); *E21B 33/128* (2013.01)

(58) Field of Classification Search
CPC ..... E21B 33/128; E21B 33/1216; E21B 23/06
See application file for complete search history.

(56) References Cited

U.S. PATENT DOCUMENTS 3,606,347 A * 9/1971 Read et al. ..... E21B 33/08 277/317
5,433,269 A * 7/1995 Hendrickson ..... E21B 33/1208 166/134

(Continued)

FOREIGN PATENT DOCUMENTS

GB 2283516 A 5/1995
GB 2427420 A 12/2006

OTHER PUBLICATIONS

International Search Report and Written Opinion dated May 7, 2020 for PCT Application No. PCT/US20/16543, 11 pages.

*Primary Examiner* — Dany E Akakpo
(74) *Attorney, Agent, or Firm* — Smith IP Services, P.C.

(57) ABSTRACT

A well barrier can include an annular seal element, an anti-extrusion backup having radially inward and radially outward portions, and a biasing device that exerts a biasing force against the radially outward portion of the anti-extrusion backup. A method of operating a well barrier can include setting the well barrier by decreasing a longitudinal distance between abutments of the well barrier, thereby compressing a seal element between the abutments, and unsetting the well barrier by increasing the longitudinal distance between the abutments and radially inwardly retracting an anti-extrusion backup positioned longitudinally between the seal element and one of the abutments. Another well barrier can include an annular seal element, an anti-extrusion backup, an abutment displaceable relative to the seal element to compress the seal element, a sleeve reciprocable relative to the abutment, and a biasing device that biases the sleeve toward the anti-extrusion backup.

15 Claims, 14 Drawing Sheets

(56) References Cited

U.S. PATENT DOCUMENTS

| | | | | |
|---|---|---|---|---|
| 8,393,388 | B2 | 3/2013 | Bishop et al. | |
| 2006/0289173 | A1 * | 12/2006 | Conaway ..... | E21B 33/1216 166/387 |
| 2009/0255690 | A1 | 10/2009 | Conner et al. | |

* cited by examiner

RETRIEVABLE ANTI-EXTRUSION FOLDBACK-RING BACKUP FOR SEALING ELEMENT

CROSS-REFERENCE TO RELATED APPLICATIONS

This application is a national stage under 35 USC 371 of International Application No. PCT/US20/16543, filed on 4 Feb. 2020, which claims priority to U.S. Provisional Application No. 62/801,496, filed on 5 Feb. 2019. The entire disclosures of these prior applications are incorporated herein by this reference.

TECHNICAL FIELD

This disclosure relates generally to equipment utilized and operations performed in conjunction with a subterranean well and, in one example described below, more particularly provides for retrieving a well barrier having an anti-extrusion backup for a seal element.

BACKGROUND

It is sometimes desirable to be able to retrieve a well tool from a well. In such circumstances, it is desirable for the well tool to have an outer size that is smaller than any obstructions or restrictions through which the well tool must pass while it is being retrieved.

Some well tools, such as well barriers (packers, plugs, hangers, etc.) are expanded in operation in a well. If the well tool has been expanded downhole, it can be difficult to retrieve the tool through the obstructions or restrictions.

It will, thus, be readily appreciated that improvements are continually needed in the arts of constructing and utilizing tools for use in subterranean wells.

DETAILED DESCRIPTION

Disclosed herein are examples of an anti-extrusion backup system that expands when set and collapses or retracts when unset. This anti-extrusion backup system is very easy to retrieve from mono-bore wells and through wellbore restrictions. This anti-extrusion backup system is suitable for high pressure and high temperature well barriers (such as, bridge plugs, packers, liner hangers, etc.).

The anti-extrusion backup system addresses the problem of extrusion in some examples by using overlapping foldback rings that are slotted or perforated in anti-extrusion backups. The foldback rings are seated against a sliding sleeve that is pre-energized in its initial position, with enough force to reposition the foldback rings to their initial position after use.

When the barrier is set downhole, the foldback rings are deformed to act as a backup to the sealing elements, and the foldback rings are supported by the sliding sleeve and a fixed gage connector. The sleeve slides over the connector and compresses a spring stack, so that the sliding sleeve is fully-energized in its set position.

Surface areas of the gage connector and sliding sleeve provide enough support for the foldback rings during operation. When the barrier is unset, the energized sleeve slides over the fixed gage connector and shifts the foldback rings to a retracted retrieve position, typically below gage (but in some cases could be slightly above gage or at gage).

The sliding sleeve can slide over the foldback rings when they are below gage, or shift the foldback rings to a retrieve position. Note that the sliding sleeve can also be pushed or pulled in position by various different means (i.e., not necessarily a spring stack).

The accompanying drawings depict examples of the anti-extrusion backup system used on a well barrier in set and unset configurations. Certain drawings depict an example in run-in (or run in hole "RIH"), set, equalized and unset configurations. In some of these examples, the foldback rings are extended radially outward when the seal elements are compressed to set the barrier, and the foldback rings are retracted inward by the sliding sleeve when the barrier is unset.

Figure 1:
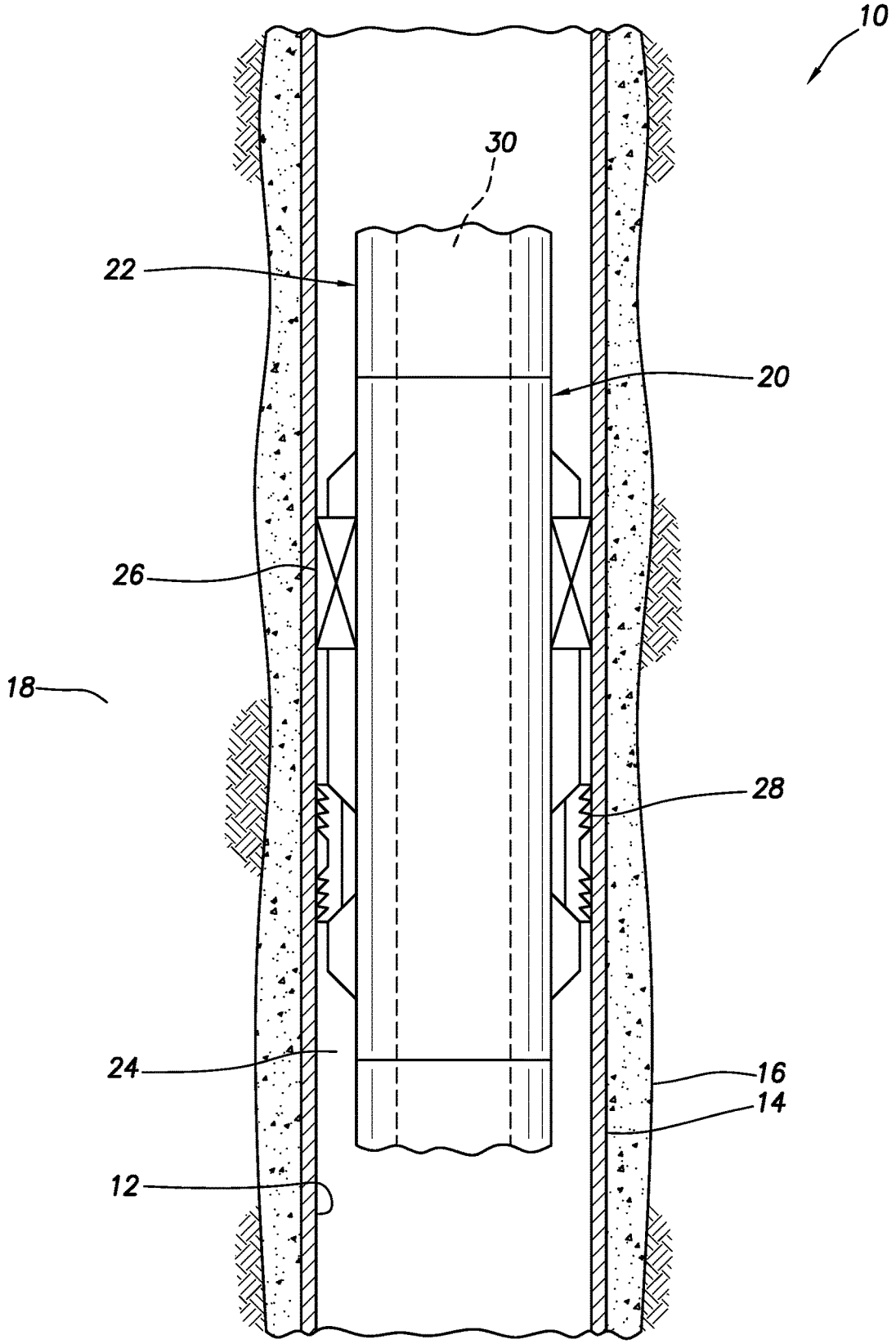
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the system 10 depicted in FIG. 1, a wellbore 12 is lined with casing 14 and cement 16. The wellbore 12 is generally vertical and extends into an earth formation 18.

In other examples, the wellbore 12 may be uncased or open hole in locations in which the principles of this disclosure are practiced. The wellbore 12 could be generally horizontal or otherwise inclined from vertical. Thus, the scope of this disclosure is not limited to any of the details of the components of the system 10 or the well with which they are used.

In the FIG. 1 example, a well barrier 20 is connected as part of a tubular string 22 positioned in the wellbore 12. The well barrier 20 is used to prevent flow through all or a portion of the wellbore 12, for example, in order to isolate sections of the wellbore from each other.

The well barrier 20 depicted in FIG. 1 is of the type known to those skilled in the art as a tubing retrievable packer, but other types of well barriers (such as, bridge plugs, frac plugs, liner hangers, etc.) may be used in other examples. In addition, it is not necessary for the well barrier 20 to be conveyed into or retrieved from the wellbore 12 using the tubular string 22 (for example, the well barrier could instead be conveyed and/or retrieved using wireline, slick line, coiled tubing or other type of conveyance). Thus, the scope of this disclosure is not limited to use of any particular type of well barrier, any particular type of conveyance, or to any particular details of the well barrier 20 as described herein or depicted in the drawings.

The well barrier 20 is configured to seal off an annulus 24 formed radially between the tubular string 22 and the wellbore 12. For this purpose, the well barrier 20 includes a radially outwardly extendable seal section 26. As described more fully below, the seal section 26 includes a seal element that can extend radially outward into sealing contact with an inner wall of the casing 14. If the wellbore 12 is uncased, the seal element can sealingly engage a wall of the earth formation 18.

The well barrier 20 in this example also includes an anchor or slip section 28. The slip section 28 secures the well barrier 20 against displacement relative to the wellbore 12. For example, the slip section 28 can enable the well barrier 20 to support loads applied to the well barrier from above or below, and the slip section can resist displacement due to a pressure differential applied across the seal section 26.

As depicted in FIG. 1, a flow passage 30 extends longitudinally through the well barrier 20 and tubular string 22. In other examples, the flow passage 30 may not extend through the well barrier 20 (for example, if the well barrier is a bridge plug, etc.).

Figure 2A:
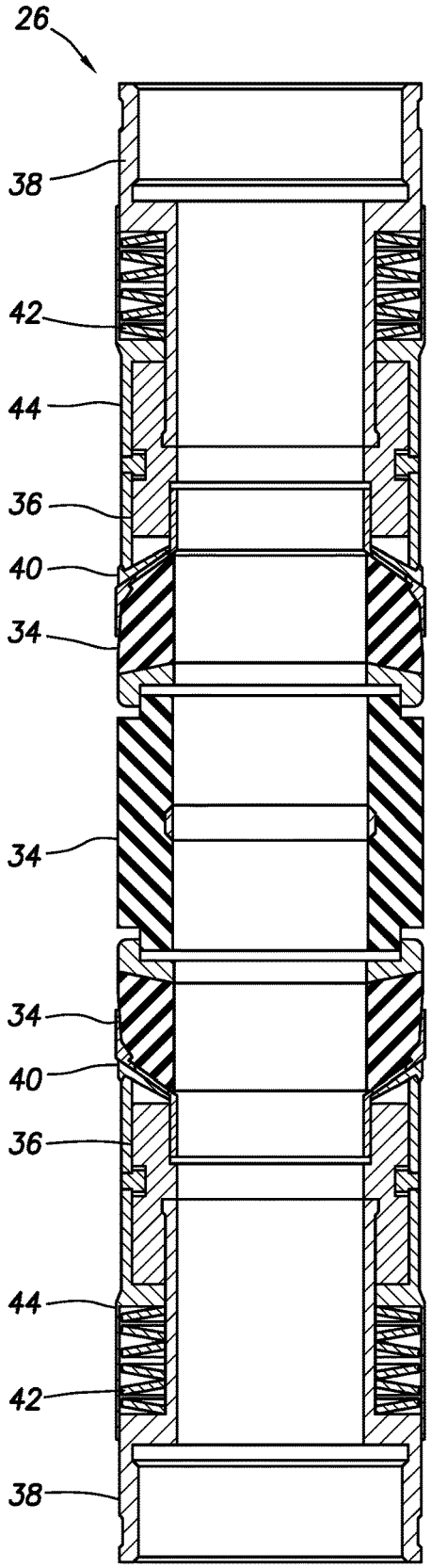
FIGS. 2A & B are representative cross-sectional views of an example of a seal section of a well barrier that may be used in the system and method of FIG. 1 in set and unset configurations.

Referring additionally now to FIGS. 2A & B, cross-sectional views of an example of the seal section 26 is representatively illustrated, apart from the system 10 and a remainder of the well barrier 20. Note that the seal section examples 26 described herein and depicted in the drawings may be used with other well barriers and in other systems, in keeping with the principles of this disclosure.

Figure 4:
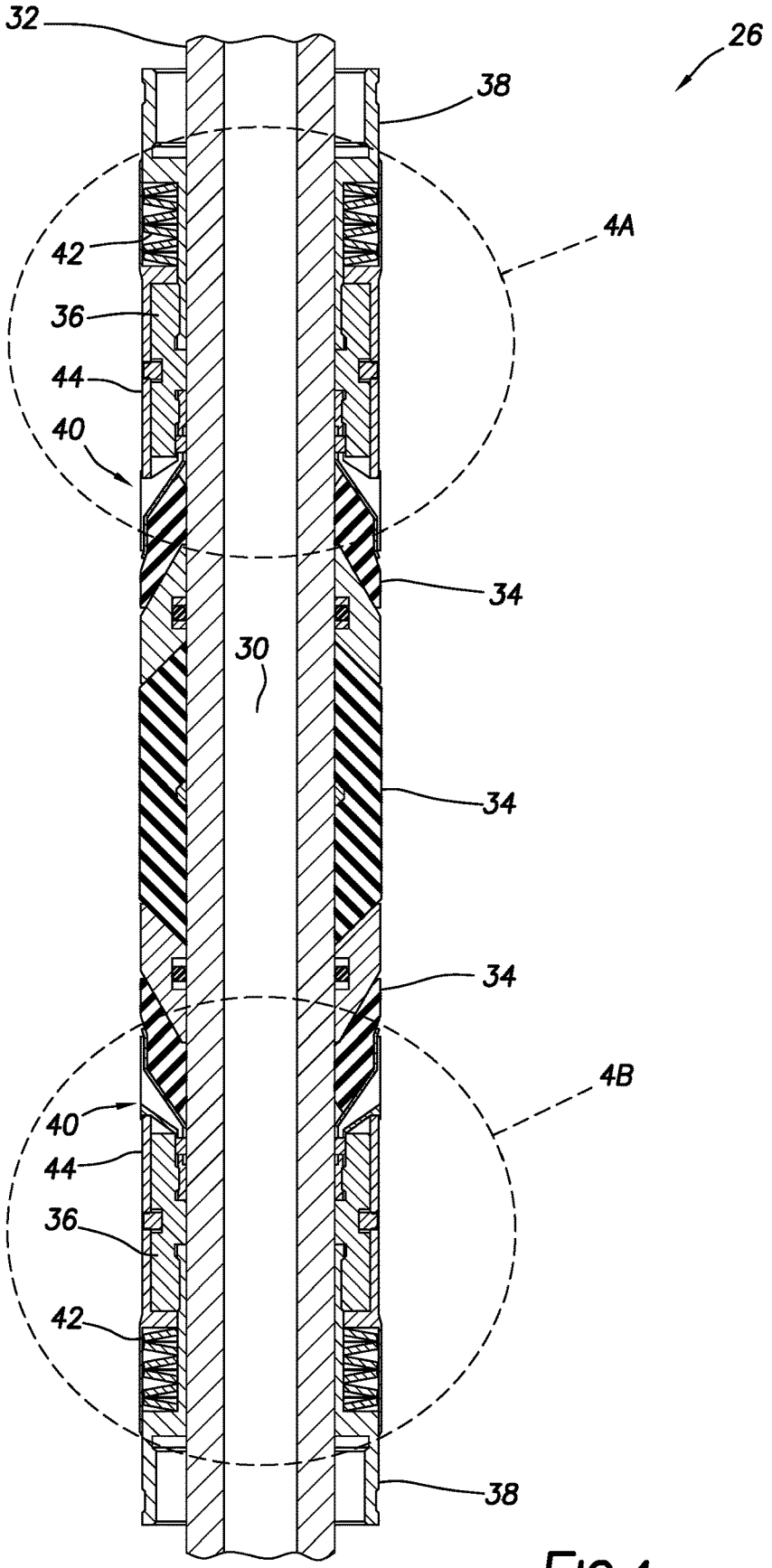
FIG. 4 is a representative cross-sectional view of another example of the seal section in an unset configuration.

The seal section 26 depicted in FIG. 2 is configured to be positioned on an inner mandrel 32 of the well barrier 20 (not shown in FIGS. 2A & B, see FIG. 4). In this example, the seal section 26 includes multiple annular seal elements 34 positioned longitudinally between two gage connectors or abutments 36. The seal elements 34 are configured so that they will extend radially outward when the seal elements are longitudinally compressed between the abutments 36.

The abutments 36 are connected to respective upper and lower connectors 38. The connectors 38 control the positions of the abutments 36, for example, enabling a distance between the abutments to be decreased (to thereby longitudinally compress the seal elements 34 between the abutments), and enabling the distance between the abutments to be increased (to thereby radially inwardly retract the seal elements).

In some examples, the abutments 36 and connectors 38 may not be separate components, but could instead be integrally formed. Thus, the scope of this disclosure is not limited to use of any particular components, combination of components, or arrangement or configuration of components in the seal section 26.

The seal section 26 depicted in FIGS. 2A & B also includes anti-extrusion backups 40. The anti-extrusion backups 40 operate to completely or partially fill a radial gap (e.g., the annulus 24 in the FIG. 1 system 10) between the well barrier 26 and the surface against which the seal elements 34 seal. This helps to prevent or minimize any extrusion of the seal elements 34 through the gap due to a pressure differential across the seal elements.

In FIG. 2A, the seal section 26 is in an unset configuration. The seal elements 34 are not radially extended.

Figure 2B:
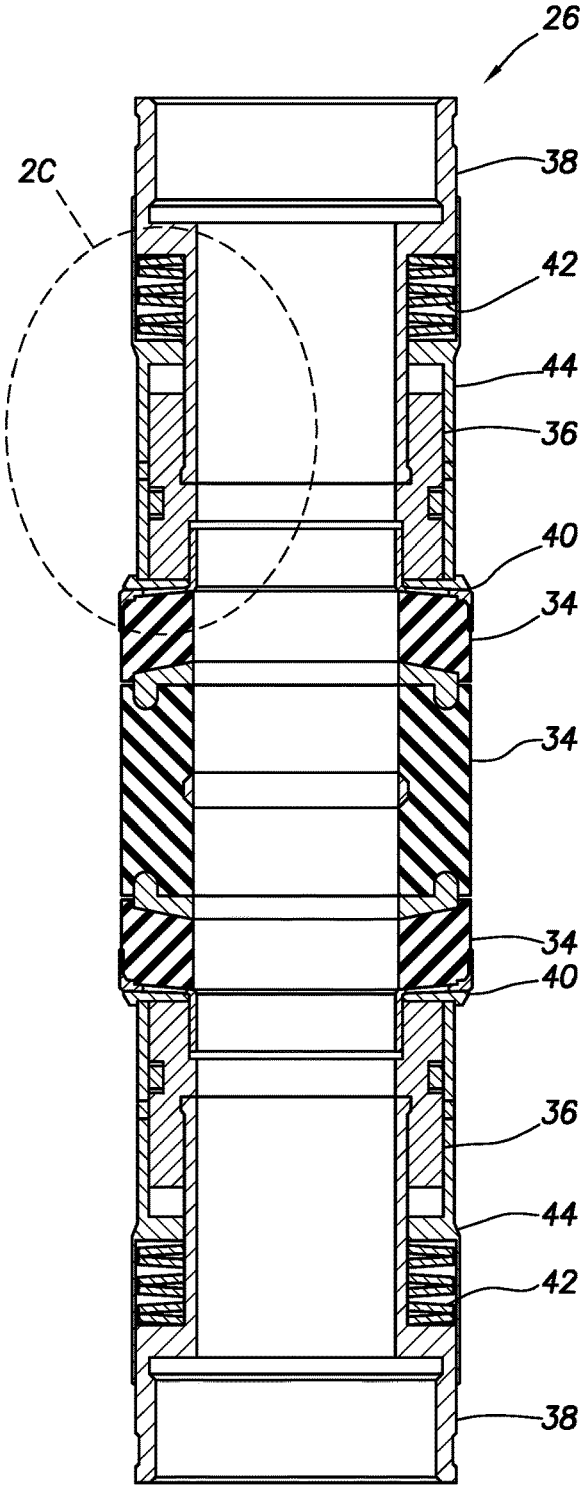
FIGS. 2C & D are representative cross-sectional views of a portion of the seal section in set and unset configurations.

In FIG. 2B, the seal section 26 is in a set configuration. The longitudinal distance between the abutments 36 is decreased (as compared to FIG. 2A), and the seal elements 34 are thereby longitudinally compressed and radial outwardly extended.

Note that the anti-extrusion backups 40 are also radially outwardly extended in the FIG. 2B set configuration. The anti-extrusion backups 40 preferably, but not necessarily, contact the surface against which the seal elements 34 seal in the set configuration.

When it is desired to unset the well barrier 20 and retrieve it from the wellbore 12, the seal section 26 can be essentially returned to its FIG. 2A configuration. In this manner, the well barrier 20 can be retrieved through any restrictions, obstructions, etc., through which it previously passed prior to being set.

To unset the well barrier 20, the longitudinal distance between the abutments 36 is increased. This allows the seal elements 34 to elongate and radially inwardly retract out of engagement with the surface against which it previously sealed.

The anti-extrusion backups 40 are radially inwardly retracted in this example by use of a biasing device 42 and sleeve 44 to apply a biasing force against a radially outward portion of each backup. This causes the backup 40 to rotate toward the adjacent seal element 34 as it radially retracts, so that the backup retracts along with the seal element.

Figure 2C:
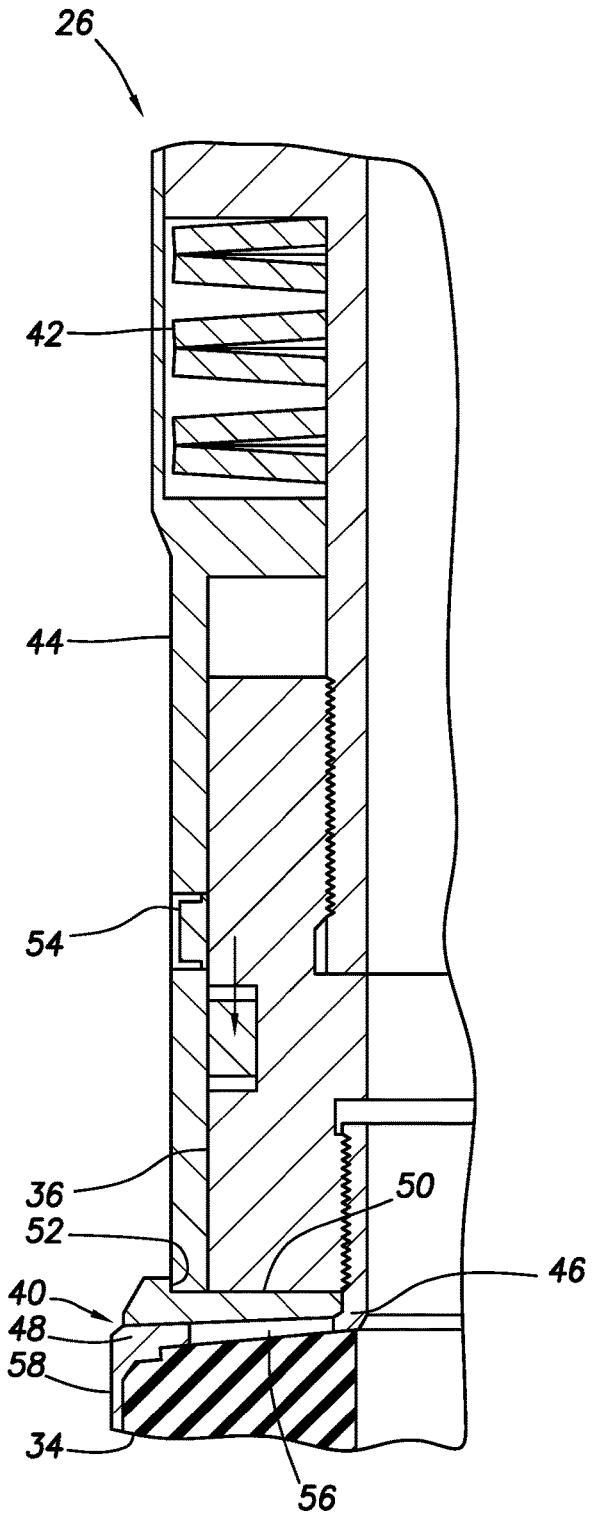

Referring additionally now to FIG. 2C, a more detailed cross-sectional view of this example of the backup 40, the biasing device 42 and the sleeve 44 is representatively illustrated in the set configuration. In this example, the abutment 36 is displaced downward toward the seal element 34 when the well barrier 20 is set. This compresses the backup 40 between the abutment 36 and the seal element 34, causing an intermediate portion of the backup to rotate so that it extends radially outward.

As depicted in FIG. 2C, a radially inward portion 46 of the backup 40 is secured to the abutment 36, so that the radially inward portion displaces (or remains motionless) with the abutment. A radially outward portion 48 of the backup 40 is able to displace longitudinally somewhat relative to the radially inward portion 46 and the abutment 36. Thus, the backup 40 can rotate between the radially inward and radially outward portions 46, 48.

In this example, the anti-extrusion backup 40 includes an annular-shaped fold-back ring 50. The fold-back ring 50 facilitates return of the anti-extrusion backup 40 to its radially retracted unset configuration (see FIG. 2D). In some examples, the fold-back ring 50 can be stiffer than the intermediate portion of the anti-extrusion backup 40 between the radially inward and radially outward portions 46, 48, so that the fold-back ring helps the anti-extrusion backup to maintain its shape as it transitions from the set to the unset configuration.

Note that the sleeve 44 radially outwardly surrounds the abutment 36 and is positioned to apply a biasing force to the radially outward portion 48 of the backup 40. In the FIGS. 2C & D example, the fold-back ring 50 is configured with a shoulder 52 for secure engagement with an end of the sleeve 44 in both of the set and unset configurations.

Figure 2D:
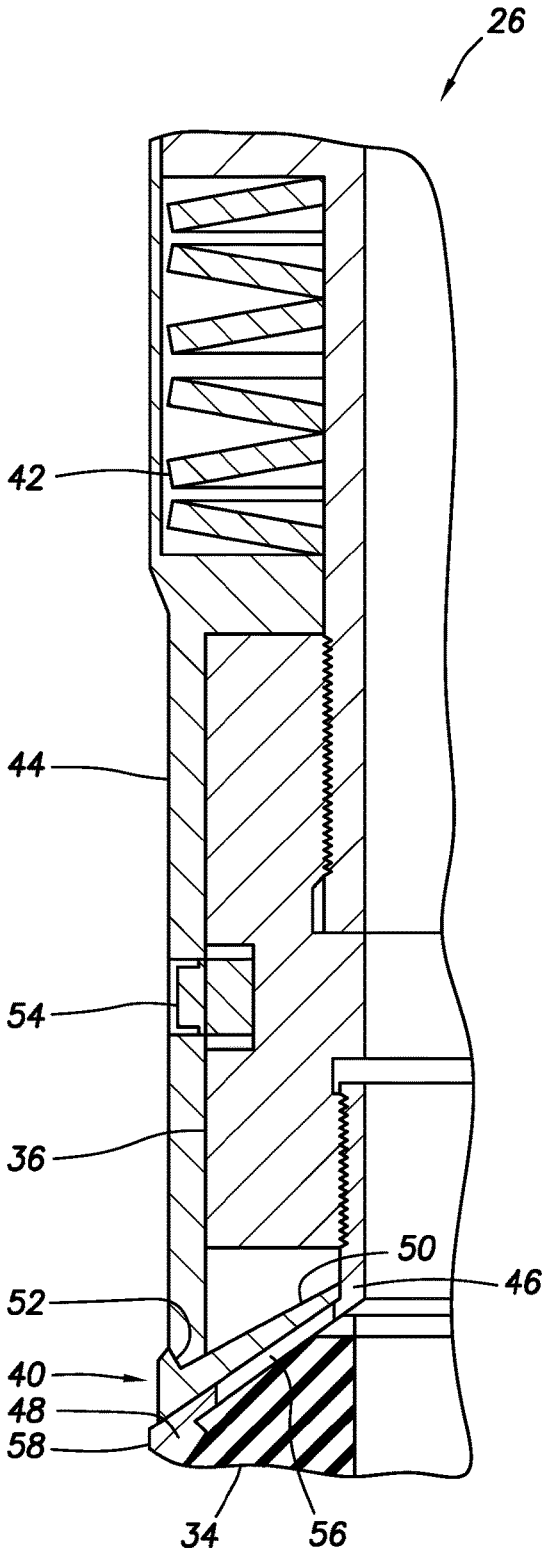

As depicted in FIG. 2D, the biasing force exerted by the biasing device 42 via the sleeve 44 to the anti-extrusion backup 40 has caused the backup to rotate to its retracted unset configuration. Preferably, the anti-extrusion backup 50 and the seal element 34 have an outer diameter that is no greater than that of a gage diameter of the well barrier 20 (such as, a maximum outer diameter of the sleeve 44) in the unset configuration.

In this example, the sleeve 44 contacts the anti-extrusion backup 40 in both the set and unset configurations. The biasing device 42 may be pre-loaded, so that a biasing force is exerted against the radially outward portion 48 of the backup 40 in the unset configuration. The biasing force may be increased as the sleeve 44 displaces relative to the abutment 36 to the set configuration. This increased biasing force may then be used to rotate the backup 40 back to its retracted unset configuration when it is desired to retrieve the well barrier 20.

The biasing device 42 in this example comprises a stack of Belleville spring washers. In other examples, the biasing device 42 could comprise another type of spring, an elastomer, a piston and pressurized chamber, or any other device capable of applying a resilient biasing force to the anti-extrusion backup 40.

In the initial unset configuration, a shear screw 54 releasably secures against relative displacement between the abutment 36 and the sleeve 44. However, when the well barrier 20 is set, the shear screw is sheared, thereby permitting relative displacement between the abutment 36 and the sleeve 44.

Figure 3B:
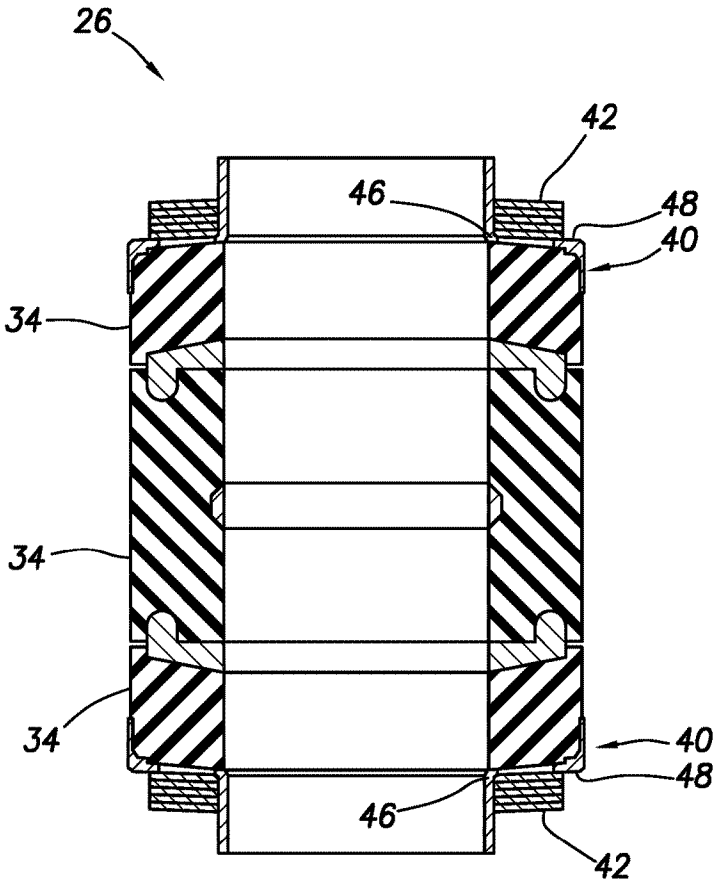
FIGS. 3A & B are representative cross-sectional views of another example of the seal section in unset and set configurations.
Figure 3A:
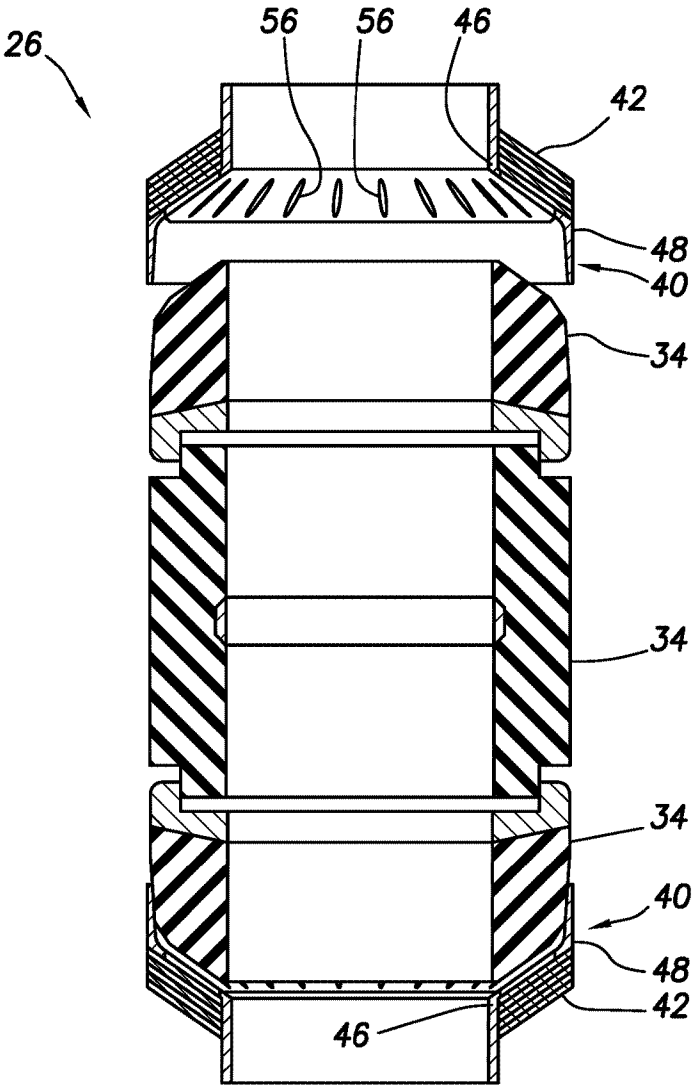

Referring additionally now to FIGS. 3A & B, another example of the seal section 26 is representatively illustrated in respective unset and set configurations. In this example, the sleeve 44 is not used. Instead, the biasing device 42 applies the biasing force directly to the anti-extrusion backup 40.

In addition, the fold-back ring 50 is not used in the anti-extrusion backup 40 of FIGS. 3A & B. In FIG. 3A, it may be seen that the intermediate portion of the backup 40 is provided with perforations or slots 56 to make it more readily deformable. In other examples, the backup 40 could comprise overlapping radially extending flexible leaves, or another arrangement suitable for deforming from the unset to the set configuration, and then deforming from the set to the unset configuration.

The biasing device 42 in the FIGS. 3A & B example comprises multiple Belleville spring washers stacked in a same orientation. In this manner, one of the spring washers is in contact with the intermediate portion of the anti-extrusion backup 40.

In the FIG. 3A unset configuration, the biasing device 42 is radially retracted. Preferably, the biasing device 42 does not extent outward past a gage diameter of the well barrier 20. If desired, a pre-load may be applied to the biasing device 42, but preferably the pre-load will not cause the biasing device to extend outward past the gage diameter.

In the FIG. 3B set configuration, the backup 40 and the biasing device 42 have rotated somewhat, due to the longitudinal compression of the seal section 26, so that the backup and the biasing device are radially outwardly extended. The abutments 36 are not shown in FIGS. 3A & B, but it will be appreciated that the abutments 36 or another type of abutments, shoulders or gage rings can be used to apply a longitudinally compressive force to set the well barrier 20. The longitudinally compressive force is removed when the well barrier 20 is unset.

When the longitudinally compressive force is removed, the biasing force exerted by the biasing device 42 against the radially outward portion of the backup 40 will cause the backup to rotate back to its radially retracted unset configuration (as depicted in FIG. 3A). The biasing device 42 (the individual spring washers) will also rotate back to their radially retracted unset configuration when the compressive force is removed.

Referring additionally now to FIG. 4, another example of the seal section 26 is representatively illustrated in an unset configuration. In this example, the seal section 26 includes different anti-extrusion backups 40. An upper abutment 36, anti-extrusion backup 40, biasing device 42 and sleeve 44 are depicted in FIG. 4A, and a lower abutment 36, anti-extrusion backup 40, biasing device 42 and sleeve 44 are depicted in FIG. 4B.

Figure 4A:
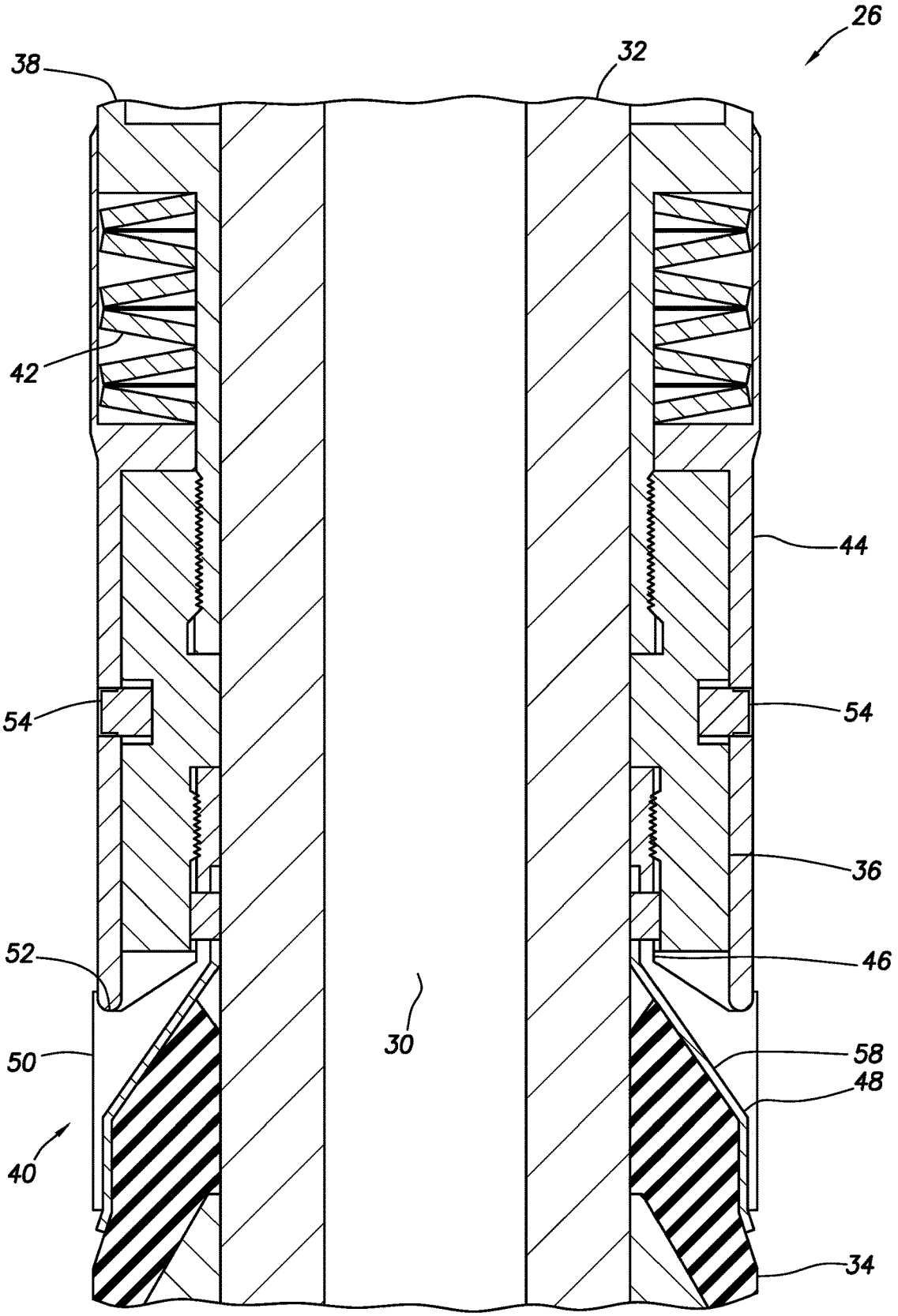
FIGS. 4A & B are representative cross-sectional views of respective portions of the FIG. 4 seal section.

In the FIG. 4A example, the anti-extrusion backup 40 includes the fold-back ring 50. The fold-back ring 50 has a frustoconical shape in this example and makes up a majority of the anti-extrusion backup 40. A thinner backup ring 58 is interposed between the fold-back ring 50 and the seal element 34. The backup ring 58 radially outwardly overlaps an end of the seal element 34. The fold-back ring 50 radially outwardly overlaps most of the backup ring 58.

Note that the radially inward portion 46 of the anti-extrusion backup 40 (including both of the fold-back ring 50 and the backup ring 58) is secured to the abutment 36 in this example. This ensures that the radially outward portion 48 of the anti-extrusion backup 40 will be rotated radially inward by the biasing force exerted by the biasing device 42 when the well barrier 20 is unset.

Figure 4B:
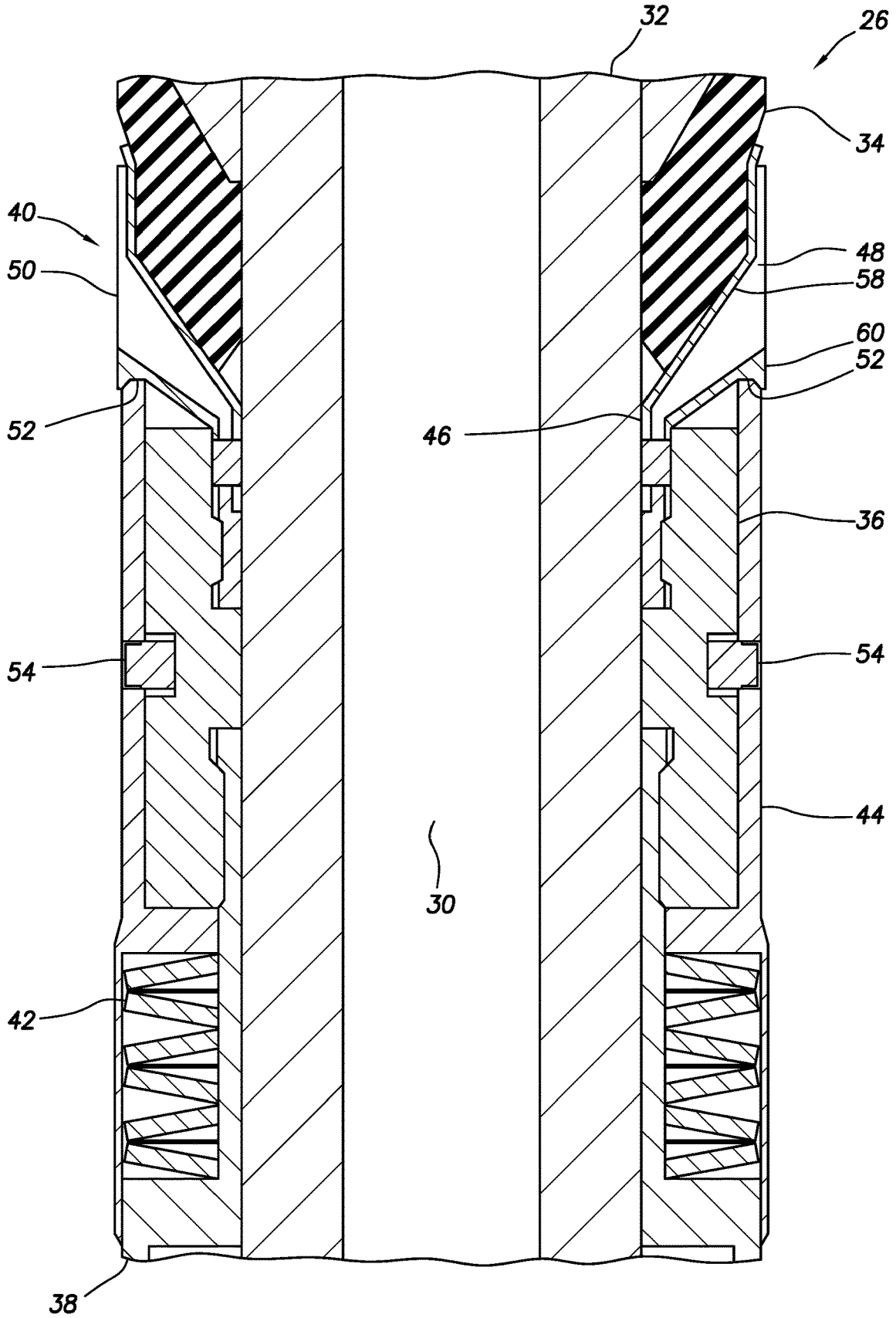

In the FIG. 4B example, an additional fold-back ring 60 is used. The fold-back ring 50 is interposed between the backup ring 58 and the fold-back ring 60.

The shoulder 52 is formed in the fold-back ring 60. Radially inward portions of the fold-back rings 50, 60 and the backup ring 58 are all secured to the abutment 36.

Figure 5A:
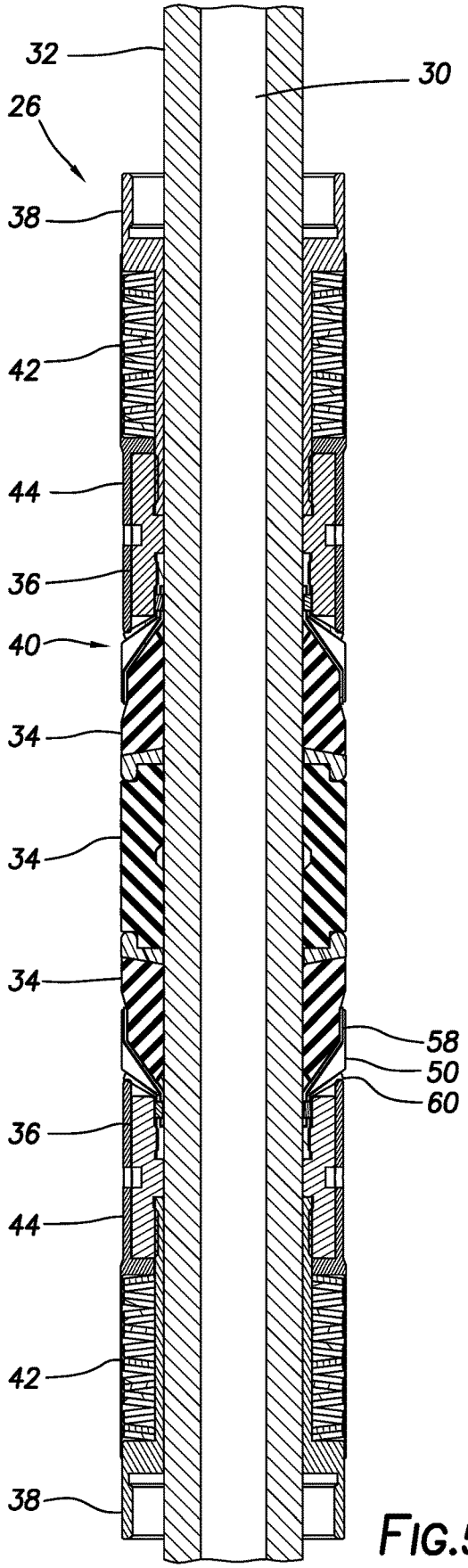
FIGS. 5A & B are representative cross-sectional views of another example of the seal section in unset and set configurations.
Figure 5B:
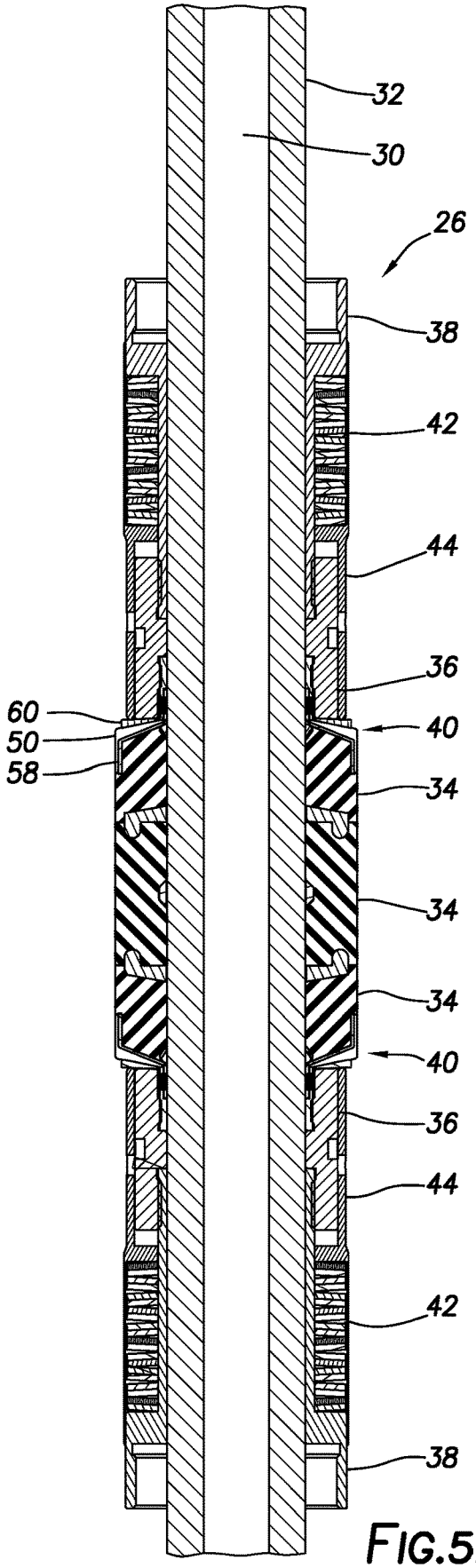

Referring additionally now to FIGS. 5A & B, another example of the seal section 26 is representatively illustrated, in respective unset and set configurations. In this example, the anti-extrusion backup 40 is similar to the FIG. 4B example, in that it includes the multiple fold-back rings 50, 60 as well as the backup ring 58.

Figure 6A:
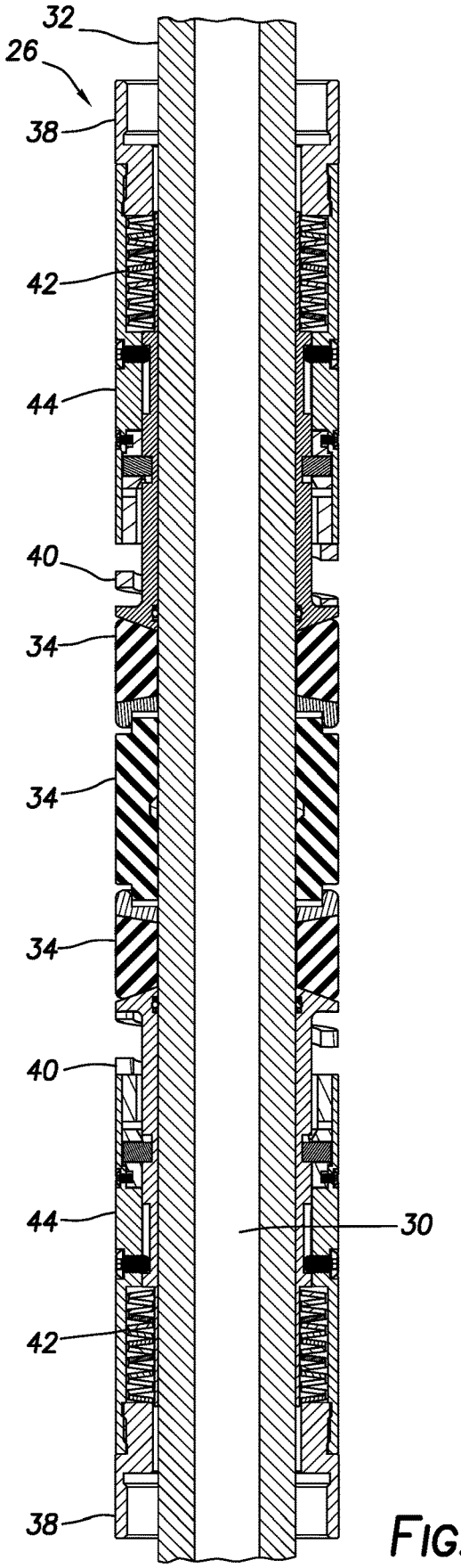
FIGS. 6A & B are representative cross-sectional views of another example of the seal section in unset and set configurations.
Figure 6B:
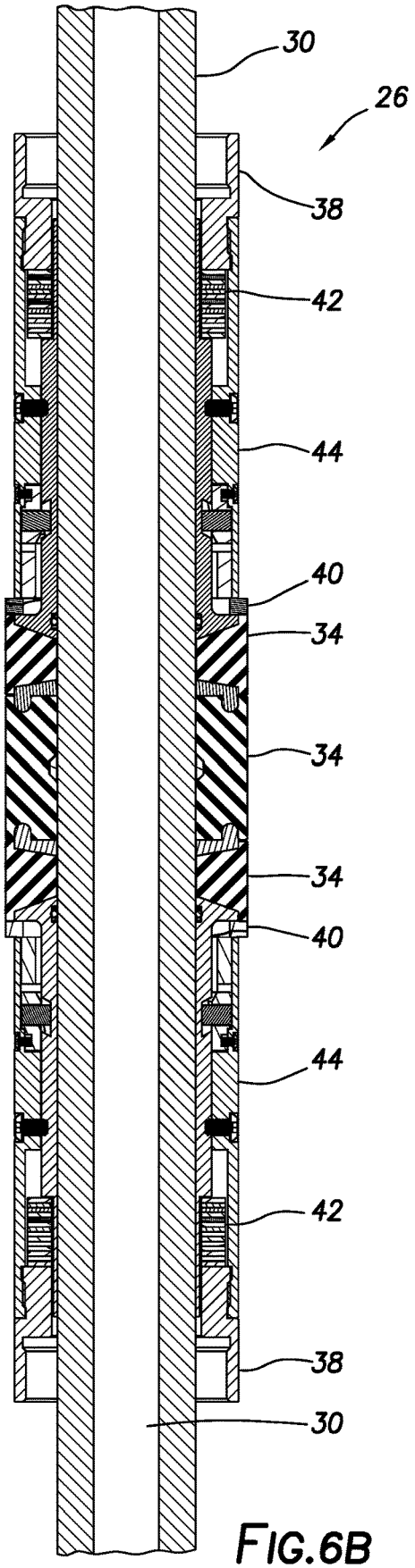

Referring additionally now to FIGS. 6A & B, another example of the seal section 26 is representatively illustrated, in respective unset and set configurations. In this example, the anti-extrusion backup 40 extends radially outward and the biasing device 42 is compressed when the well barrier 20 is set as depicted in FIG. 6B. The anti-extrusion backup 40 radially retracts, due to the compressed biasing device 42, when the well barrier 20 is unset as depicted in FIG. 6A.

Referring additionally now to FIGS. 7A-D, another example of the well barrier 20 is representatively illustrated in run-in, set, equalized and released or unset configurations. Only an upper portion of the well barrier 20 including the seal section 26 is depicted in FIGS. 7A-D. In this example, the anti-extrusion backups 40 are similar to that depicted in FIG. 4A.

Figure 7A:
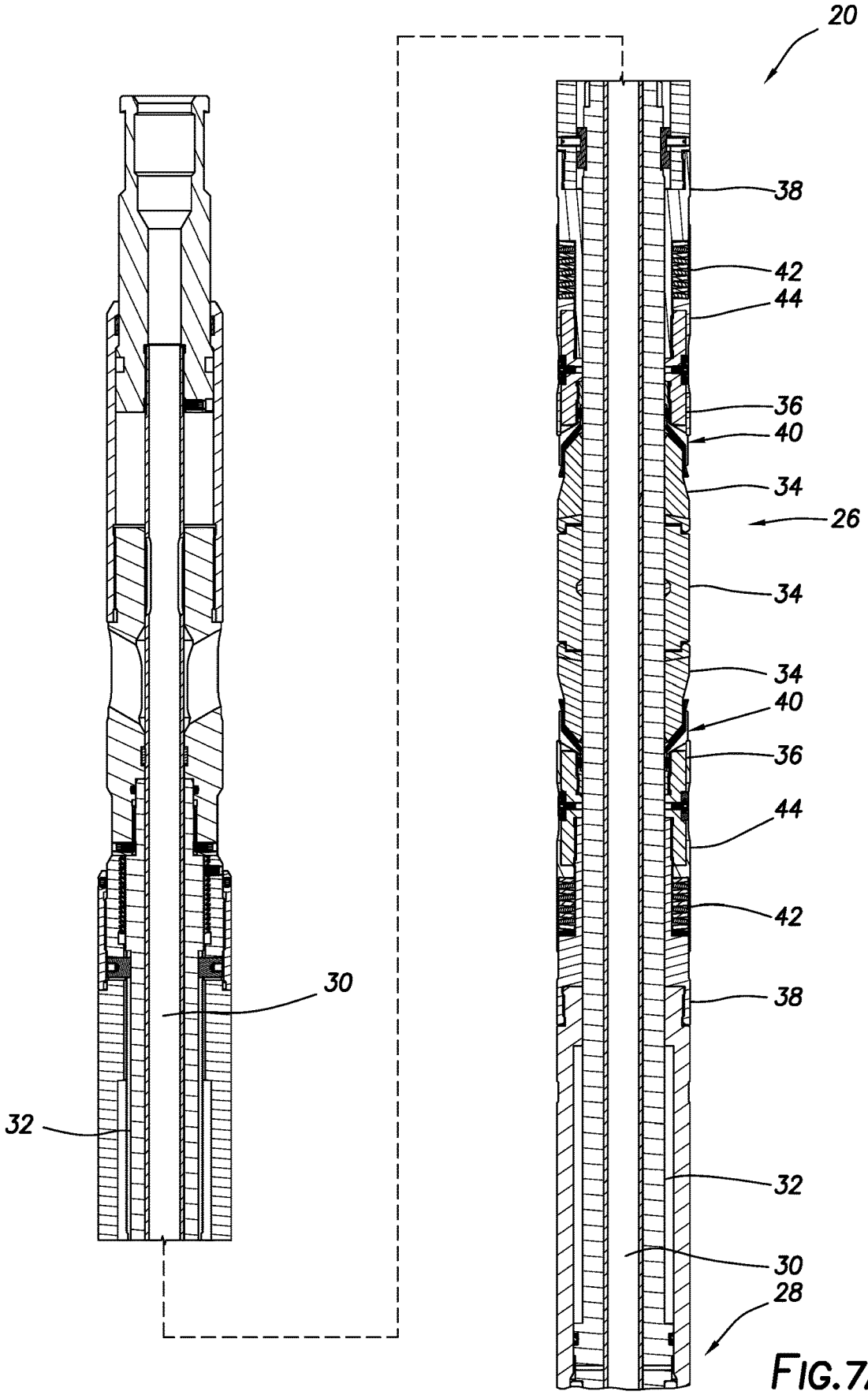
FIGS. 7A-D are representative cross-sectional views of an example of the well barrier in run-in, set, equalized and released or unset configurations.

In the run-in configuration of FIG. 7A, the well barrier 20 is suited to be conveyed into a wellbore or tubular string, which in some cases can include restrictions or obstructions. Accordingly, the seal section 26 is radially retracted, with the seal elements 34 and anti-extrusion backups 40 preferably at or below a gage diameter of the well barrier 20

Figure 7B:
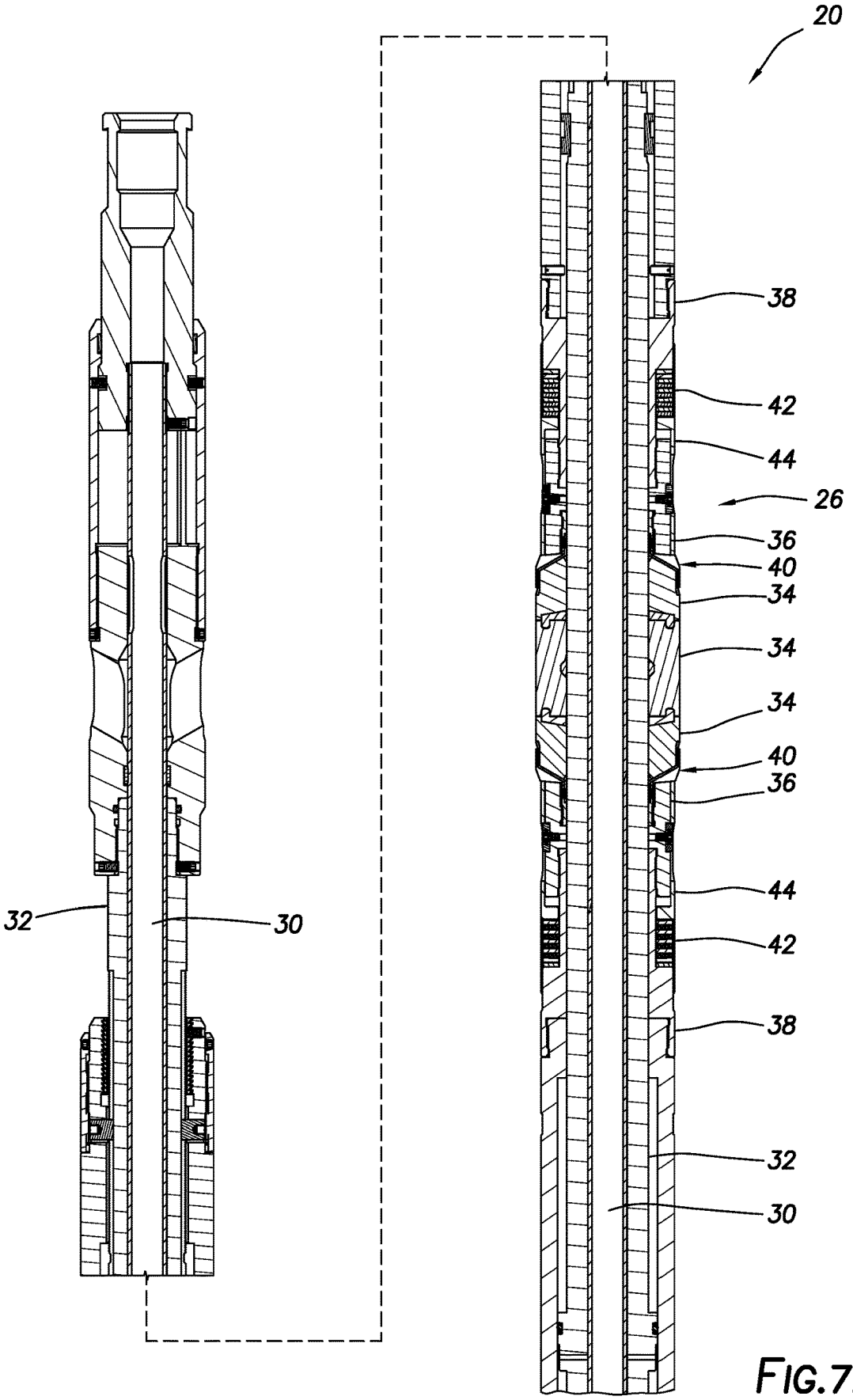

In the set configuration of FIG. 7B, the longitudinal distance between the abutments 36 is decreased, so that the seal elements 34 are longitudinally compressed and radially outwardly extended. The anti-extrusion backups 40 are also radially outwardly extended, and the biasing device 42 is further compressed to thereby increase the biasing force exerted on the sleeve 44 (and the radially outward portion 48 of the backup 40).

Figure 7C:
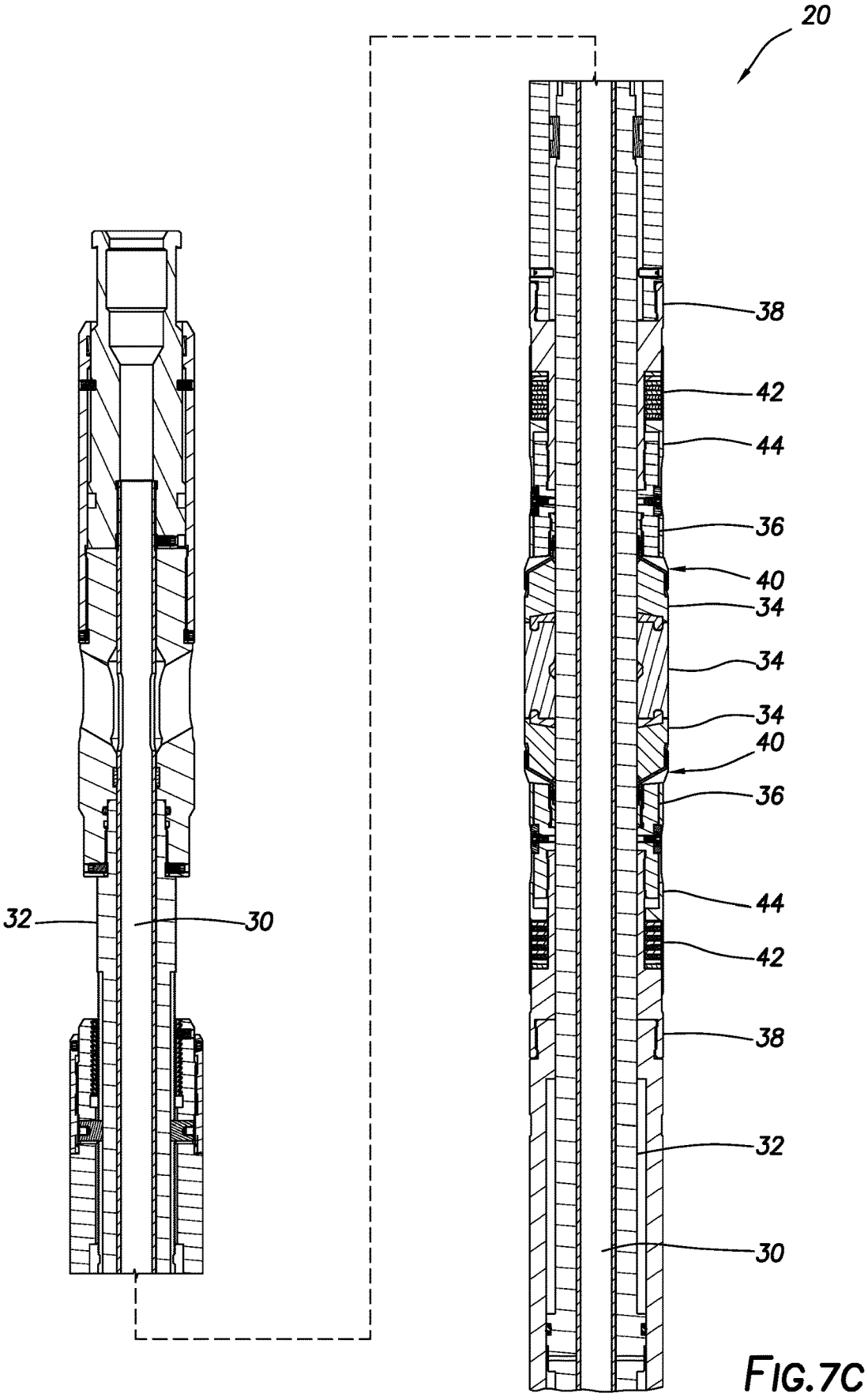

In the equalized configuration of FIG. 7C, any pressure differential across the seal elements 34 is relieved, in preparation for unsetting the well barrier 20. As depicted in FIG. 7C, the seal elements 34 and anti-extrusion backups 40 remain radially outwardly extended.

Figure 7D:
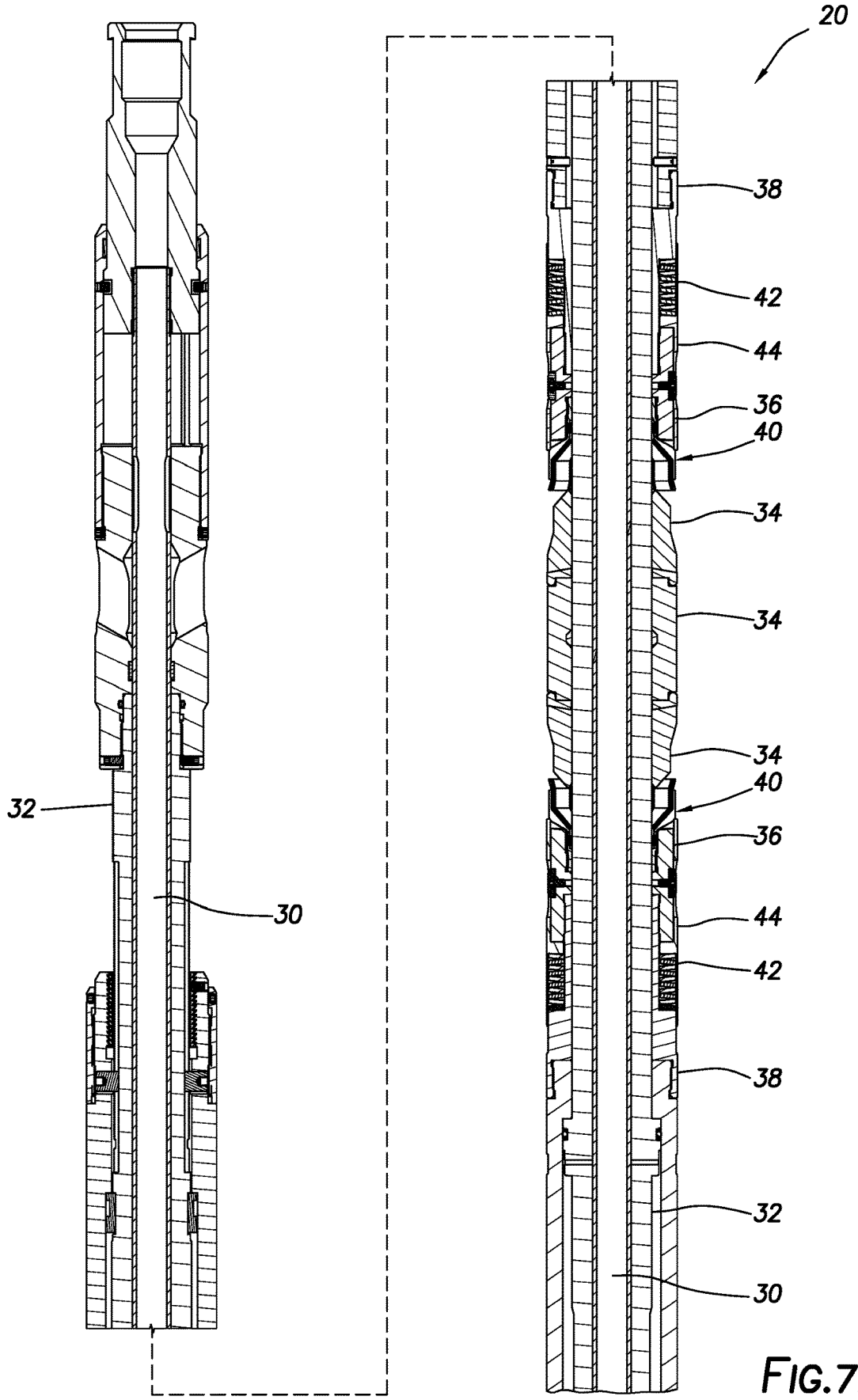

In the unset configuration of FIG. 7D, the longitudinal distance between the abutments 36 is increased, thereby permitting the seal elements 34 to radially inwardly retract. In addition, the biasing forces exerted against the upper portions 48 of the anti-extrusion backups 40 (see FIG. 4B) has caused the backups to rotate inward to their radially retracted positions. The well barrier 20 can now be conveniently retrieved, including through any restrictions or obstructions through which it may have previously been conveyed.

Figure 8A:
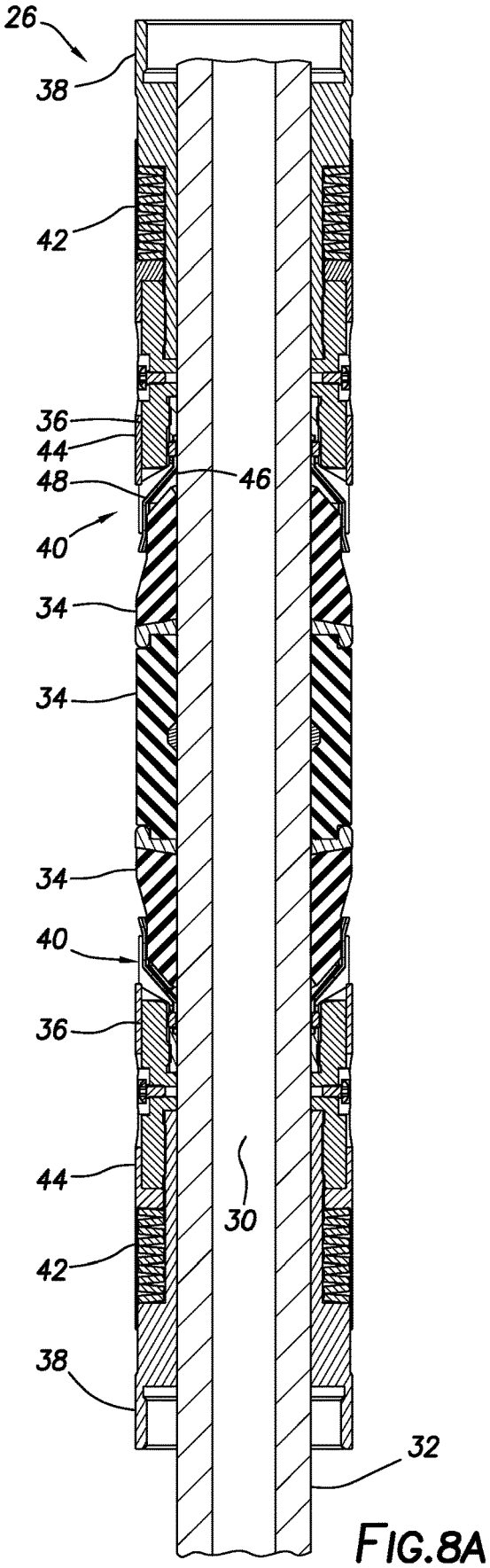
FIGS. 8A & B are representative cross-sectional views of another example of the seal section in unset and set configurations.

Referring additionally now to FIGS. 8A & B, another example of the seal section 26 is representatively illustrated in respective unset and set configurations. In this example, the anti-extrusion backups 40 are similar to that depicted in FIG. 4A.

Figure 8B:
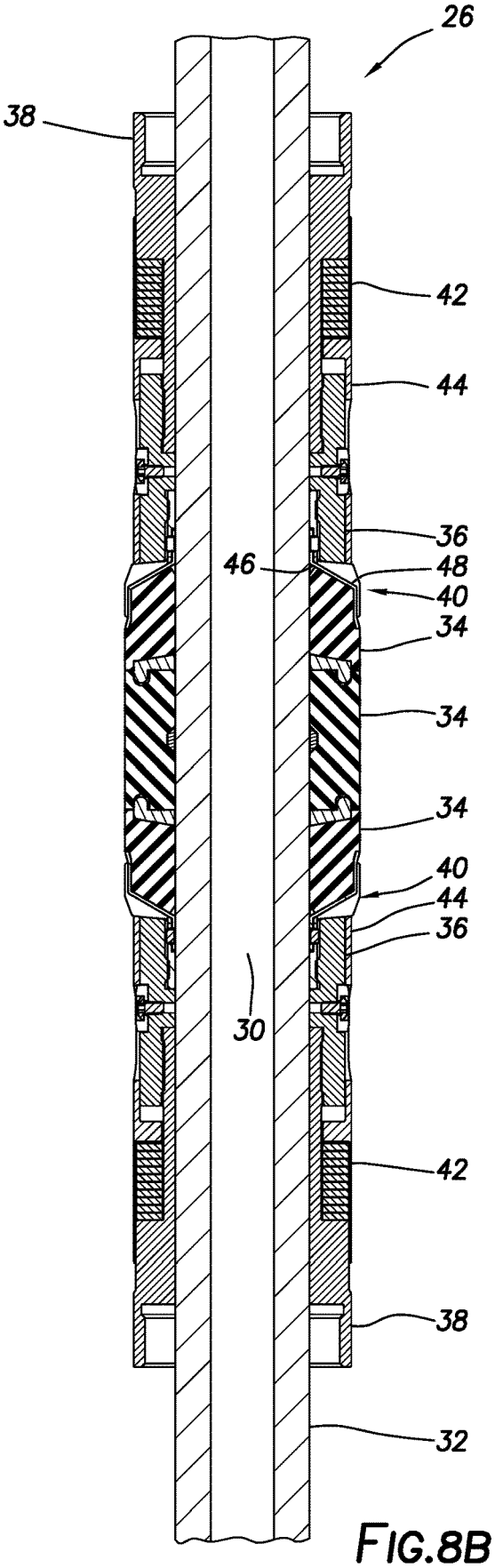

In the FIG. 8A unset configuration, the seal elements 34 and the backups 40 are radially retracted. In the FIG. 8B set configuration, the seal elements 34 and the backups 40 are radially extended, due to longitudinal compression of the seal section 26.

In the process of transitioning from the unset to the set configuration, the backup 40 rotates outward (the radially outward portion 48 rotates outward relative to the radially inward portion 46, which is secured to the abutment 36). In the process of transitioning from the set to the unset configuration, the backup 40 rotates inward (the radially outward portion 48 rotates inward relative to the radially inward portion 46, which is secured to the abutment 36), due to the biasing force exerted by the biasing device 42.

It may now be fully appreciated that the above disclosure provides significant advancements to the art of constructing and utilizing well barriers for subterranean wells. In some examples described herein, the well barrier 20 includes features that enable the anti-extrusion backup 40 to be radially retracted (for example, to its initial unset configuration) prior to retrieving the well barrier from a well.

The above disclosure provides to the art a well barrier 20. In one example, the well barrier 20 can include an annular seal element 34, an anti-extrusion backup 40 having radially inward and radially outward portions 46, 48, and a biasing device 42 that exerts a biasing force against the radially outward portion 48 of the anti-extrusion backup 40.

In any of the examples described herein, the well barrier 20 may include an abutment 36. The radially inward portion 46 of the anti-extrusion backup 40 may be secured against longitudinal displacement relative to the abutment 36.

In any of the examples described herein, the radially outward portion 48 of the anti-extrusion backup 40 may be longitudinally displaceable relative to the abutment 36.

In any of the examples described herein, the anti-extrusion backup 40 may retract radially inward in response to the biasing force applied to the radially outward portion 48 of the anti-extrusion backup 40.

In any of the examples described herein, the biasing device 42 may comprise at least one Belleville spring washer.

In any of the examples described herein, the biasing device 42 may exert the biasing force against a sleeve 44 reciprocably disposed relative to the anti-extrusion backup 40.

In any of the examples described herein, the sleeve 44 may be reciprocably disposed relative to an abutment 36, the seal element 34 may extend radially outward in response to a compressive force applied between the abutment 36 and the seal element 34, and the sleeve 44 may surround the abutment 36.

In any of the examples described herein, the anti-extrusion backup 40 may include a fold-back ring 50. The fold-back ring 50 may retract radially inward in response to application of the biasing force to the radially outward portion 48 of the anti-extrusion backup 40.

The above disclosure also provides to the art a method of operating a well barrier 20. In one example, the method can include: setting the well barrier 20 by decreasing a longitudinal distance between first and second abutments 36 of the well barrier 20, thereby compressing a seal element 34 between the first and second abutments 36; and unsetting the well barrier 20 by increasing the longitudinal distance between the first and second abutments 36. The unsetting step includes radially inwardly retracting an anti-extrusion backup 40 positioned longitudinally between the seal element 34 and the first abutment 36.

In any of the examples described herein, the anti-extrusion backup 40 may expand radially outward in response to the compressing of the seal element 34.

In any of the examples described herein, the retracting step can include applying a biasing force to a radially outward portion 48 of the anti-extrusion backup 40.

In any of the examples described herein, the biasing force applying step may include a biasing device 42 biasing a sleeve 44 to displace relative to the first abutment 36 and toward the seal element 34.

In any of the examples described herein, the sleeve 44 may surround the first abutment 36.

In any of the examples described herein, the setting step may include displacing the sleeve 44 relative to the first abutment 36 in a first direction, and the unsetting step may include displacing the sleeve 44 relative to the first abutment 36 in a second direction opposite to the first direction.

In any of the examples described herein, the setting step may include increasing the biasing force.

In any of the examples described herein, the setting step may include rotating a portion of the anti-extrusion backup 40 in a first direction, and the unsetting step may include rotating the portion of the anti-extrusion backup 40 in a second direction opposite to the first direction.

Also described above is another well barrier 20. In this example, the well barrier 20 can include an annular seal element 34, an anti-extrusion backup 40, an abutment 36 displaceable relative to the seal element 34 to compress the seal element 34, a sleeve 44 reciprocable relative to the abutment 36, and a biasing device 42 that biases the sleeve 44 toward the anti-extrusion backup 40.

In any of the examples described herein, a radially inward portion 46 of the anti-extrusion backup 40 may be secured relative to the abutment 36.

In any of the examples described herein, the biasing device 42 may bias the sleeve 44 into contact with a radially outward portion 48 of the anti-extrusion backup 40.

In any of the examples described herein, the radially outward portion 48 of the anti-extrusion backup 40 may be longitudinally displaceable relative to the abutment 36.

In any of the examples described herein, the anti-extrusion backup 40 may retract radially inward in response to a biasing force applied via the sleeve 44 to the radially outward portion 48 of the anti-extrusion backup 40.

In any of the examples described herein, the anti-extrusion backup 40 may include a fold-back ring 50. The fold-back ring 50 may retract radially inward in response to application of a biasing force to a radially outward portion 48 of the anti-extrusion backup 40.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well barrier, comprising:

an annular seal element;

an anti-extrusion backup having radially inward and radially outward portions; and a biasing device that is configured to exert a biasing force against the radially outward portion of the anti-extrusion backup, in which the anti-extrusion backup, is configured to retract radially inward in response to the biasing force applied to the radially outward portion of the anti-extrusion backup, and in which the biasing device is configured to exert the biasing force against a sleeve reciprocably disposed relative to the anti-extrusion backup.

2. The well barrier of claim 1, in which the sleeve is reciprocably disposed relative to an abutment, the seal element extends radially outward in response to a compressive force applied between the abutment and the seal element, and the sleeve surrounds the abutment.

3. The well barrier of claim 2, in which the anti-extrusion backup includes a fold-back ring, and the fold-back ring retracts radially inward in response to application of the biasing force to the radially outward portion of the anti-extrusion backup.

4. A method of operating a well barrier, the method comprising:

setting the well barrier by decreasing a longitudinal distance between first and second abutments of the well barrier, thereby compressing a seal element between the first and second abutments;

unsetting the well barrier by increasing the longitudinal distance between the first and second abutments; and radially inwardly retracting an anti-extrusion backup positioned longitudinally between the seal element and the first abutment in response to the increasing the longitudinal distance between the first and second abutments, in which the retracting comprises applying a biasing force to a radially outward portion of the anti-extrusion backup.

5. The method of claim 4, in which the biasing force applying comprises a biasing device biasing a sleeve to displace relative to the first abutment and toward the seal element.

6. The method of claim 5, in which the sleeve surrounds the first abutment.

7. The method of claim 5, in which the setting comprises displacing the sleeve relative to the first abutment in a first direction, and the unsetting comprises displacing the sleeve relative to the first abutment in a second direction opposite to the first direction.

8. The method of claim 4, in which the setting comprises increasing the biasing force.

9. The method of claim 4, in which the setting comprises rotating a portion of the anti-extrusion backup in a first direction, and the unsetting comprises rotating the portion of the anti-extrusion backup in a second direction opposite to the first direction.

10. A well barrier, comprising:

an annular seal element;

an anti-extrusion backup;

an abutment displaceable relative to the seal element to compress the seal element;

a sleeve reciprocable relative to the abutment; and a biasing device that is configured to bias the sleeve toward the anti-extrusion backup as the well barrier is unset.

11. The well barrier of claim 10, in which a radially inward portion of the anti-extrusion backup is secured relative to the abutment.

12. The well barrier of claim 10, in which the biasing device biases the sleeve into contact with a radially outward portion of the anti-extrusion backup.

13. The well barrier of claim 12, in which the radially outward portion of the anti-extrusion backup is longitudinally displaceable relative to the abutment.

14. The well barrier of claim 12, in which the anti-extrusion backup retracts radially inward in response to a biasing force applied via the sleeve to the radially outward portion of the anti-extrusion backup.

15. The well barrier of claim 10, in which the anti-extrusion backup includes a fold-back ring, and the fold-back ring retracts radially inward in response to application of a biasing force to a radially outward portion of the anti-extrusion backup.

* * * * *